US006655541B2

(12) United States Patent
Schütz

(10) Patent No.: US 6,655,541 B2
(45) Date of Patent: Dec. 2, 2003

(54) STORAGE CONTAINER FOR LIQUIDS

(75) Inventor: Udo Schütz, Selters (DE)

(73) Assignee: Schütz GmbH & Co. KGaA, Selters (DE)

( * ) Notice: Subject to any disclaimer, the term of this patent is extended or adjusted under 35 U.S.C. 154(b) by 0 days.

(21) Appl. No.: 10/318,348

(22) Filed: Dec. 12, 2002

(65) Prior Publication Data

US 2003/0111466 A1 Jun. 19, 2003

(30) Foreign Application Priority Data

Dec. 13, 2001 (DE) ..... 201 20 169

(51) Int. Cl.[7] ..... B65D 81/24

(52) U.S. Cl. ..... 220/560.1; 220/4.12; 220/23.87; 220/23.6; 206/597

(58) Field of Search ..... 220/4.12, 860.1, 220/587.3, 573.6, 23.87, 23.91, 23.6; 206/597

(56) References Cited

U.S. PATENT DOCUMENTS 3,187,937 A * 6/1965 Berta ..... 220/751
3,848,769 A * 11/1974 Bell ..... 220/845
4,430,084 A * 2/1984 Deaton ..... 604/317
4,780,269 A * 10/1988 Fischer et al. ..... 376/272
5,259,509 A * 11/1993 Boal et al. ..... 206/597
5,423,428 A * 6/1995 Selz ..... 206/597
5,450,965 A * 9/1995 Cox ..... 206/597
5,542,562 A * 8/1996 Oratz ..... 220/23.87
5,597,086 A * 1/1997 King-Shui ..... 220/592.16

* cited by examiner

*Primary Examiner*—Joseph M. Moy
(74) *Attorney, Agent, or Firm*—Friedrich Kueffner

(57) ABSTRACT

A sectioned storage container for liquids has an inner plastic container to be filled with a liquid and a plastic receptacle that surrounds the inner container so that an intermediate space is formed between the inner container and the receptacle. The inner container is made of at least two blow-molded monolithic parts connected with one another by a groove-shaped vertical recess extending in the sidewalls, the container bottom, and the top of the inner container. The receptacle has an insertion opening for the inner container so that the inner container projects with top portions thereof upwardly from the receptacle through the insertion opening. The sidewalls and the receptacle bottom of the receptacle have a groove-shaped vertical recess which is matched to the recess of the sidewalls and the container bottom of the inner container. A peripheral vertical reinforcement strap engages the vertical recesses and reinforces the storage container.

14 Claims, 5 Drawing Sheets

STORAGE CONTAINER FOR LIQUIDS

BACKGROUND OF THE INVENTION

1. Field of the Invention

The invention relates to a storage container for liquids, in particular, flammable liquids such as fuel oil, used oil, lubricating oil, and diesel fuel, the container comprising an inner container to be filled with the liquid and made of plastic material and a receptacle made of plastic material in which the inner container is received for leak-proofing the inner container, wherein an intermediate space is formed between the inner container and the receptacle.

2. Description of the Related Art

Storage containers of this kind, as they are known from European patent 0 901 972 B1, are used primarily for storing fuel oil in buildings. Because of the configuration of the storage container comprising a collecting receptacle for leak-proofing the inner container, it is no longer necessary to build a protective wall at the site where the storage container is to be set up or to provide a separate collecting container. In the known storage container, the upper edge of the tub-shaped receptacle is located at the level of the fill socket, the removal socket, and the venting socket of the inner container, and the receptacle is connected with its upper edge to the inner container for providing a gas-tight enclosure of the intermediate space between the receptacle and the inner container. For increasing the shape stability and the static load capacity, the sidewalls of the inner container and of the receptacle are provided across the entire container height with groove-shaped peripheral recesses.

The construction of such known storage containers is relatively complex, and the manufacture of the container is accordingly expensive. A further disadvantage of the storage container resides in that the transport to the respective set-up location is cumbersome.

SUMMARY OF THE INVENTION

It is an object of the present invention to develop a storage container for liquids of the aforementioned kind such that is characterized by a simple construction, an inexpensive manufacture, and excellent transportability.

In accordance with the present invention, this is achieved in that the inner container of the storage container, which is formed as a sectioned container, is comprised of at least two container parts which container parts are formed as a monolithic part by blow molding and are connected with one another by a groove-shaped vertical recess extending in the sidewalls, the bottom, and the top of the inner container, wherein the receptacle has an insertion opening for the inner container, wherein the inner container projects with the top portions of the two container parts through the insertion opening of the receptacle in the upward direction away from the receptacle, wherein the sidewalls and the receptacle bottom of the receptacle have a groove-shaped vertical recess which is matched to the recess of the sidewalls and the container bottom of the inner container, and wherein the storage container is reinforced by a peripheral vertical strap which engages the vertical recesses of the inner container and of the receptacle.

The storage container according to the invention is characterized by a simple configuration, low manufacturing costs, low weight, a minimal space requirement as a result of the compact shaping, a high safety as a result of the receptacle provided for liquid which may leak from the inner container, the use of a shape-integrated steel pipe strap for increasing the shape stability, an excellent long-term stability, an absolute corrosion resistance and freedom of maintenance because of blow molding of the inner container and of the receptacle of high-pressure process polyethylene, and excellent transportability by optionally furnishing the storage container with a steel pipe pallet or a transport and storage frame.

DESCRIPTION OF THE PREFERRED EMBODIMENTS

Figure 1:
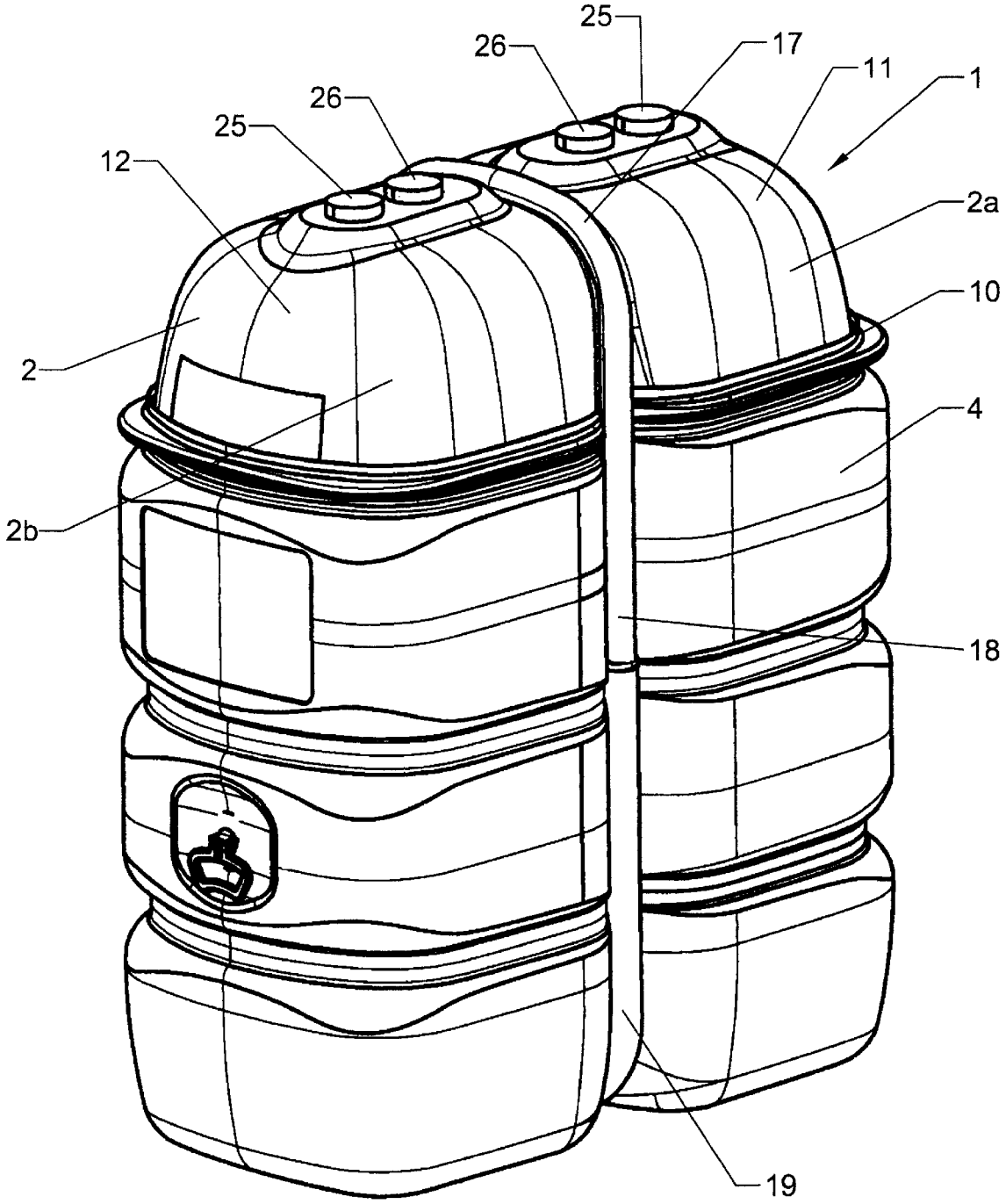
FIG. 1 is a perspective illustration of a storage container according to the invention.
Figure 3:
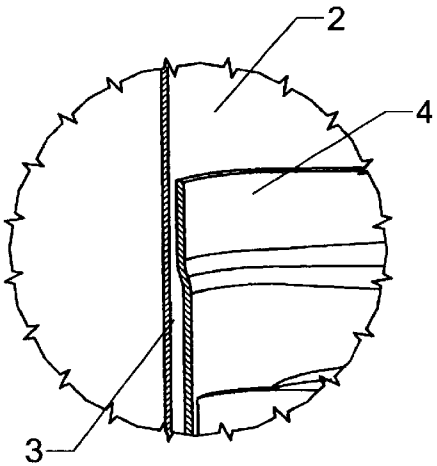
FIG. 3 is a detail view of the storage container according to the detail III of FIG. 2.

The storage container 1 according to FIGS. 1 through 5, which is embodied as a sectional container and is designed for storing fuel oil or heating oil, has as a main component an inner container 2 made of plastic material for receiving the heating oil as well as a receptacle 4 made of plastic material and surrounding the inner container 2 for leak-proofing the inner container 2. An intermediate space 3 is formed between the inner container 2 and the receptacle 4.

The inner container 2 is comprised of two identical container parts 2*a*, 2*b*, which are blow-molded as monolithic parts of plastic material, preferably polyethylene, and are connected with one another by a groove-shaped, vertical recess 5 of the sidewalls 6, 7, the container bottom 8, and the top 9 of the inner container 2.

The receptacle 4 has an insertion opening 10 for the inner container 2. The inner container 2 projects with the upper portions 11, 12 of the two container parts 2*a*, 2*b* through the insertion opening 10 of the receptacle 4 in the upward direction away from the receptacle 4.

A groove-shaped vertical recess 16 is formed in the two sidewalls 13, 14 and the receptacle bottom 15 of the receptacle 4 and matches the recess 5 provided in the sidewalls 6, 7 and in the container bottom 8 of the inner container 2.

The storage container 1 is reinforced by a peripheral vertical strap 17 which engages the vertical recesses 5, 16 of the inner container 2 and of the receptacle 4 and is comprised of two U-shaped pipes 18, 19 made of steel and insertable into one another.

The sidewalls 13, 14 and the end walls 20, 21 of the receptacle 4 have groove-shaped circumferential recesses 22 distributed across the height of the receptacle for increasing the shape stability of the receptacle 4 and for supporting and centering the inner container 2 as well as for forming the intermediate space 3 between the receptacle 4 and inner container 2 provided for receiving the liquid which may leak from the inner container 2.

On the upper opening rim 23 of the receptacle 4 a peripheral grip edge 24 is provided for handling the storage container 1 and for attachment of a shrinking foil for protection of the fill and removal fixtures connected to the fill and removal sockets 25, 26 of the storage container 1 during transport of the container.

When manufacturing the receptacle 4, the upper container part of the monolithic blow-molded container is cut off.

The inner container 2 has grip depressions 29 on the end walls 27, 28, and drop handles 30 are provided on the end walls 20, 21 of the receptacle 4.

Figure 8:
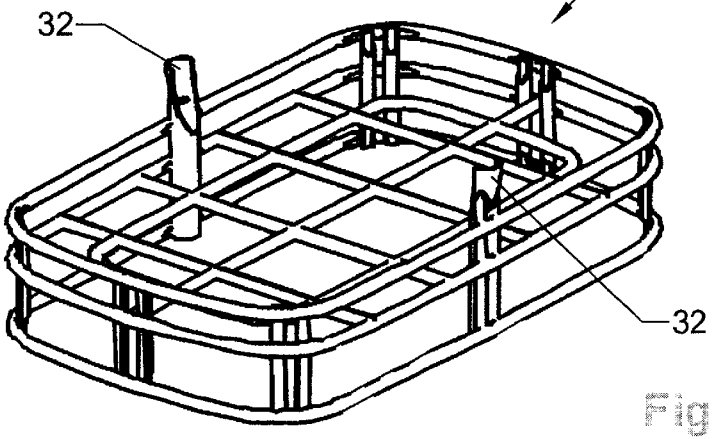
FIG. 8 is a perspective illustration of the transport pallet of the storage container according to FIGS. 6 and 7.
Figure 2:
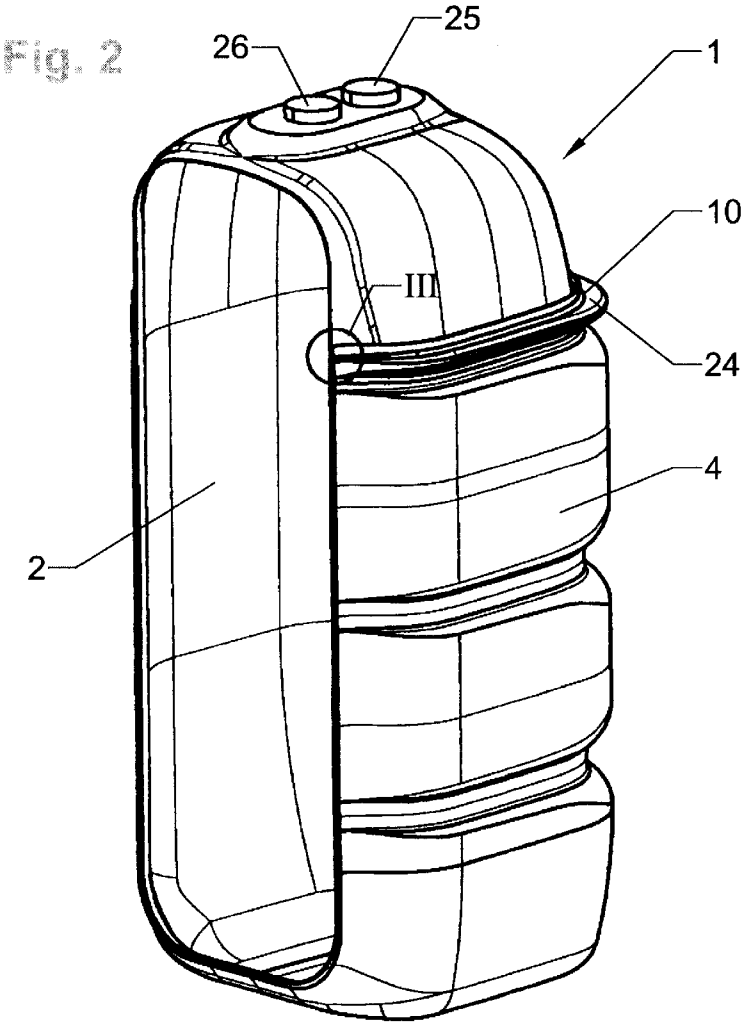
FIG. 2 is a central vertical section of the storage container of FIG. 1.
Figures 4, 5:
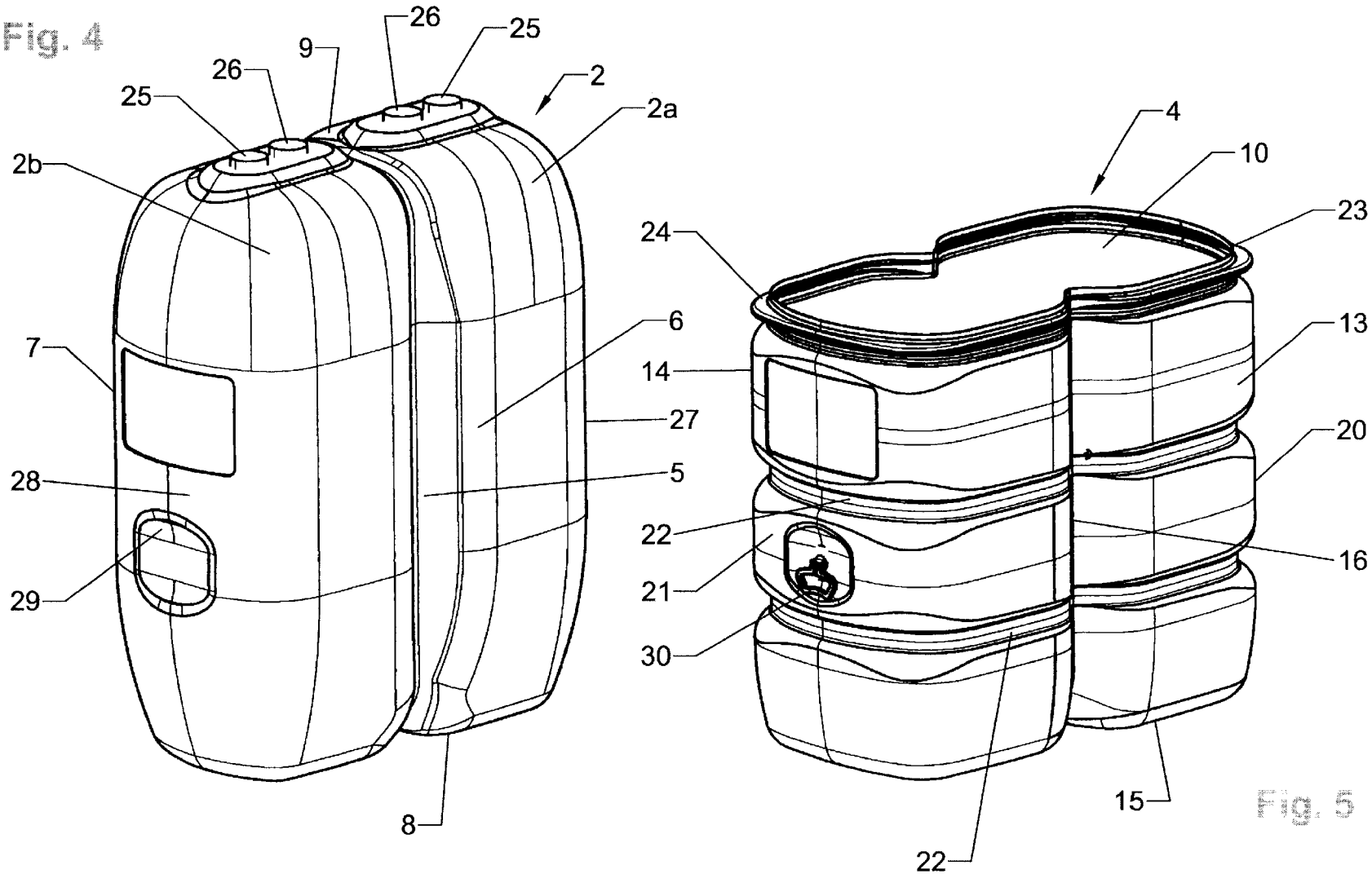
FIG. 4 is a perspective illustration of the inner container of the storage container according to the invention.
FIG. 5 is a perspective illustration of the receptacle of the storage container according to the invention.
Figures 6, 7:
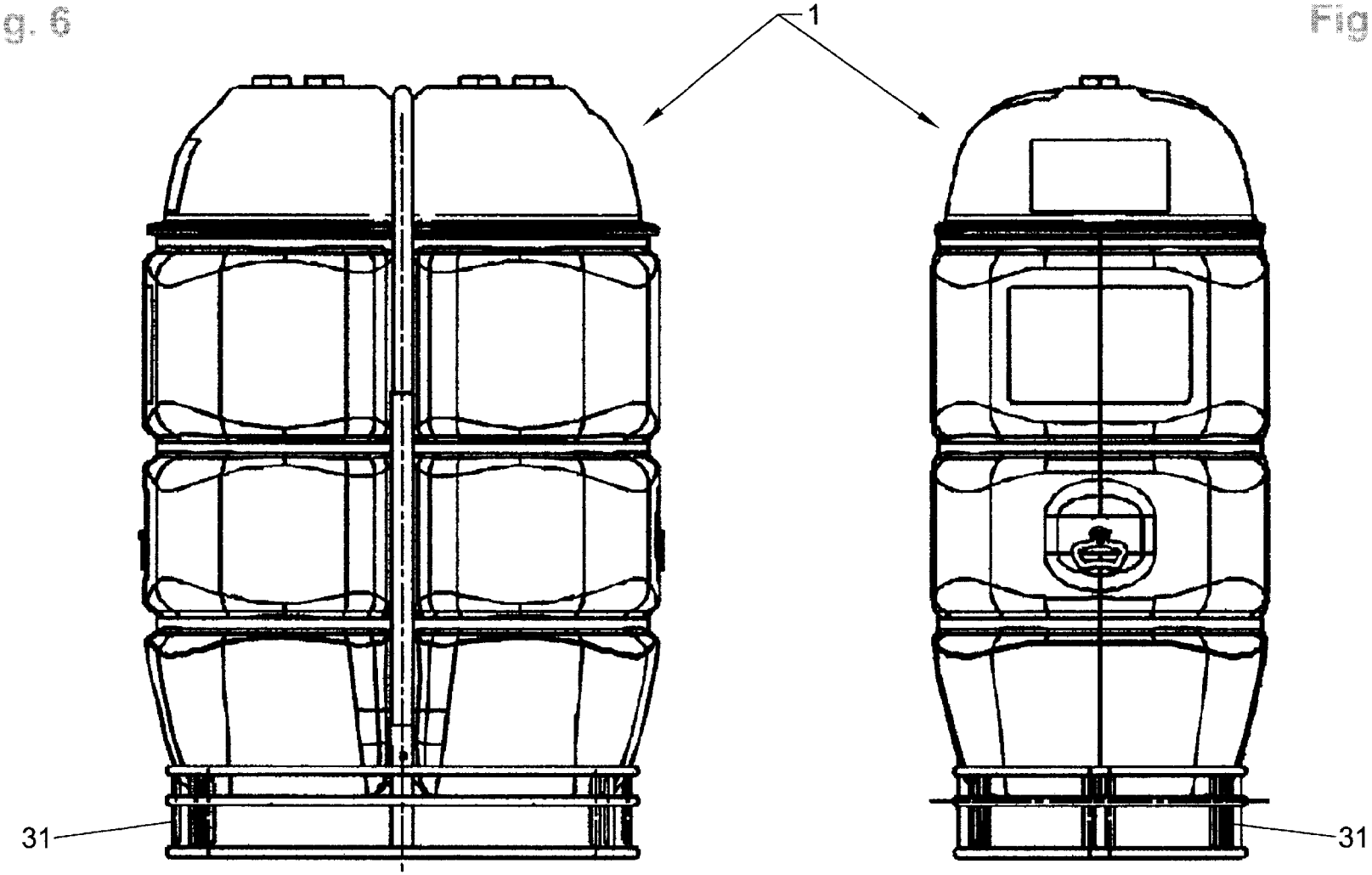
FIG. 6 is a side view of a storage container fastened on a transport pallet.
FIG. 7 is an end view of the storage container of FIG. 6.
Figure 10:
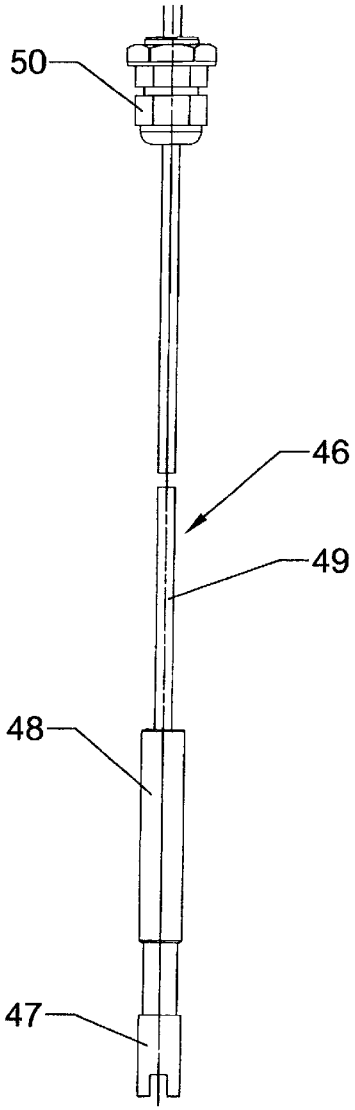
FIG. 10 is a schematic illustration of a leak indicator of the storage container.

The storage container 1 illustrated in FIGS. 6 and 7 is provided with a transport and storage pallet 31 according to FIG. 8 which is embodied as a steel pipe pallet. The storage container 1 is connected by means of the reinforcement strap 17 with screws to supports 32 on the two longitudinal sides of the transport pallet 31.

Figure 9:
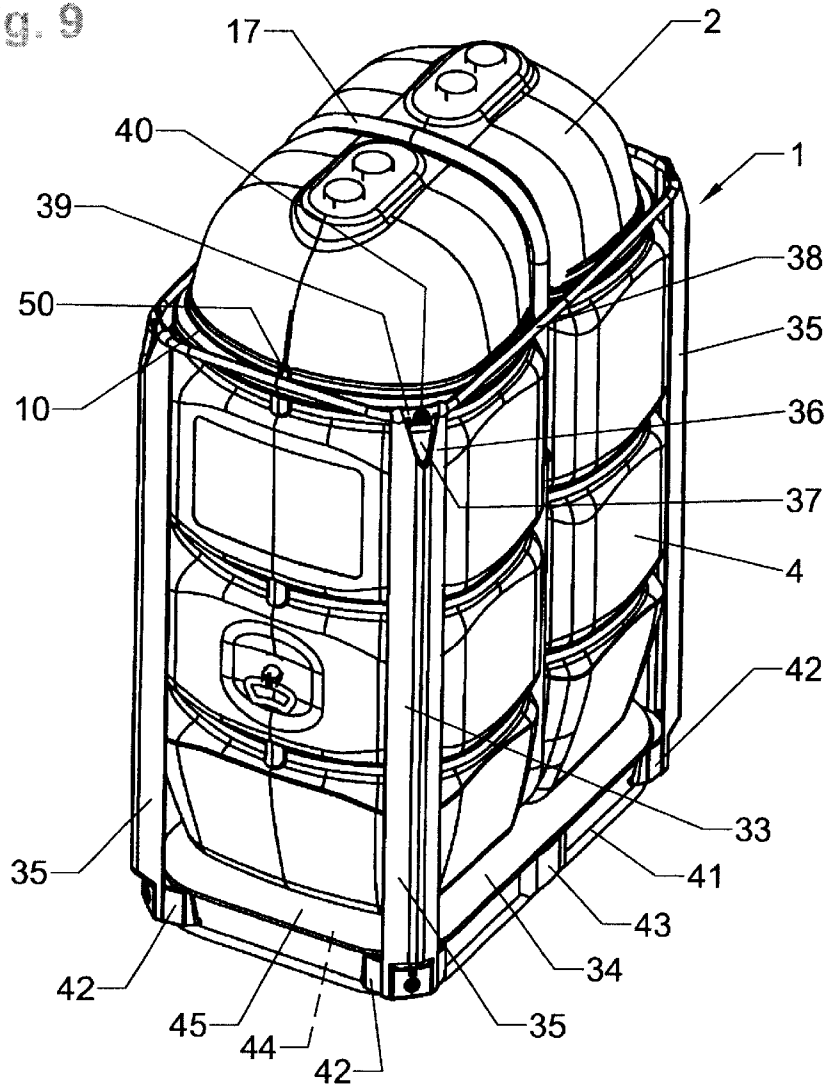
FIG. 9 is a perspective illustration of a storage container provided with a transport and storage frame.

The storage container 1 according to FIG. 9 is provided with a transport and storage frame 33 which is formed of a pallet 34 with four vertical corner posts 35 which extend into the area of the insertion opening 10 of the receptacle 4. The upper ends 36 are provided with an opening 37 for hooking the gear hook of a lifting device such as a crane. The upper ends 36 of the four corner posts 35 of the pallet 34 are connected to one another by a single-part or four-part reinforcement frame 38 (as illustrated). The frame 38 is fastened by a screw 40 on a stay 39 above the hook opening 37 of the four corner posts 35, respectively. The hook openings 37 of the four corner posts 35 of the transport and storage frame 33 have a triangular shape that widens in the upward direction so that a crane hook can be suspended from the openings 37 without being impaired by the fastening screw 40 of the reinforcement frame 38

The pallet 34 of the transport and storage frame 33 is comprised of a base frame 41, four corner legs 42 on which the corner posts 35 are fastened, two center legs 43 as well as an upper frame 44 fastened on the corner and center legs 42, 43. The frame 44 has transverse members for supporting a flat pallet bottom 45 on which the storage container 1 is positioned.

The storage container 1 can be provided by the manufacturer with an optical and acoustic leak indicator 46 or can be retrofitted later on by the operator with such a device. The leak indicator 46 is provided with a measuring sensor 47 which, together with a weight 48, is suspended on an electrical transmission cable 49 in the intermediate space 3 between inner container 2 and the receptacle 4 to the receptacle bottom 15 of the receptacle 4 and is fastened by means of a strain relief device 50 on the upper rim 23 of the opening of the receptacle 4. In a leak situation, a control signal is sent by the measuring sensor 47 to an alarm device (not illustrated) connected to the transmission cable 49. The alarm device has optical and/or acoustic indicators such as an illuminating indicator and a buzzing alarm which are activated by the control signal.

While specific embodiments of the invention have been shown and described in detail to illustrate the inventive principles, it will be understood that the invention may be embodied otherwise without departing from such principles.

What is claimed is:

1. A sectioned storage container for liquids, the storage container comprising:

an inner container configured to be filled with a liquid and comprised of plastic material, the inner container having sidewalls, end walls, a container bottom and a top;

a receptacle made of plastic material and having sidewalls, end walls, and a receptacle bottom;

wherein the receptacle surrounds the inner container so that an intermediate space is formed between the inner container and the receptacle;

wherein the inner container is comprised of at least two container parts, which container parts are blow-molded as monolithic parts and are connected with one another by a groove-shaped vertical recess extending in the sidewalls, the container bottom, and the top of the inner container;

wherein the receptacle has an insertion opening for the inner container, wherein the inner container projects with upper portions of the two container parts in an upward direction from the receptacle through the insertion opening of the receptacle;

wherein the sidewalls and the receptacle bottom of the receptacle have a groove-shaped vertical recess which is matched to the recess of the sidewalls and the container bottom of the inner container; and a peripheral vertical reinforcement strap engaging the vertical recesses of the inner container and of the receptacle for reinforcing the storage container.

2. The storage container according to claim 1, wherein the sidewalls and the end walls of the receptacle have groove-shaped circumferential recesses distributed across a height of the receptacle for increasing a shape stability of the receptacle, for supporting and centering the inner container in the receptacle, and for forming the intermediate space between the receptacle and the inner container for receiving liquid leaking from the inner container.

3. The storage container according to claim 1, wherein the insertion opening has an upper opening rim provided with a grip edge for handling the storage container and for attaching a shrinking foil for protection of filling and removing fixtures connected to filling and removing sockets of the storage container during transport of the storage container.

4. The storage container according to claim 1, wherein the reinforcement strap is comprised of two insertable U-shaped steel pipes.

5. The storage container according to claim 1, wherein the end walls of the inner container have grip depressions.

6. The storage container according to claim 1, wherein the receptacle comprises drop handles connected to the end walls of the receptacle.

7. The storage container according to claim 1, further comprising a transport and storage pallet.

8. The storage container according to claim 7, wherein the transport and storage pallet has longitudinal sides provided with supports and wherein the reinforcement strap is fastened by screwing to the supports.

9. The storage container according to claim 7, wherein the pallet is comprised of steel pipe.

10. The storage container according to claim 1, further comprising a transport and storage frame.

11. The storage container according to claim 10, wherein the transport and storage frame is comprised of a pallet having four vertical corner posts extending up to the inser tion opening of the receptacle and provided at upper ends thereof with an opening configured to receive a hook of a lifting device, wherein the upper ends of the four corner posts are connected to one another by a single-part or multi-part reinforcement frame.

12. The storage container according to claim 10, wherein the pallet comprises a base frame having four corner legs and two center legs and further comprises an upper frame and a flat pallet bottom supported on the upper frame, wherein the corner posts are fastened to the corner legs and wherein the receptacle and the inner container are positioned on the flat pallet bottom.

13. The storage container according to claim 11, wherein the pallet is comprised of steel pipe.

14. The storage container according to claim 1, comprising at least one of an optical leak indicator and an acoustic leak indicator.

* * * * *